United States Patent [19]

Dötzer et al.

[11] 4,101,386

[45] Jul. 18, 1978

[54] METHODS OF COATING AND SURFACE FINISHING ARTICLES MADE OF METALS AND THEIR ALLOYS

[75] Inventors: Richard Dötzer; Klaus Stöger, both of Nüremberg, Fed. Rep. of Germany

[73] Assignee: Siemens Aktiengesellschaft, Munich, Fed. Rep. of Germany

[21] Appl. No.: 691,707

[22] Filed: Jun. 1, 1976

Related U.S. Application Data

[60] Division of Ser. No. 300,906, Oct. 26, 1972, Pat. No. 3,969,195, which is a continuation-in-part of Ser. No. 249,279, May 1, 1972, abandoned.

[30] Foreign Application Priority Data

May 7, 1971 [DE] Fed. Rep. of Germany ..... 2122610
Oct. 28, 1971 [DE] Fed. Rep. of Germany ..... 2153831

[51] Int. Cl.[2] ..... C25D 5/34; C25D 5/42; C25D 5/44

[52] U.S. Cl. ..... 204/32 R; 204/14 N; 204/33

[58] Field of Search ..... 204/14 N, 32 R, 33, 204/141.5, 145 F

[56] References Cited

U.S. PATENT DOCUMENTS

| | | | |
|---|---|---|---|
| 2,285,548 | 6/1942 | Wesley | 204/34 |
| 2,285,549 | 6/1942 | Wesley | 204/34 |
| 2,873,233 | 2/1959 | Schnable | 204/32 R |
| 2,901,383 | 8/1959 | Lebsanft | 134/7 |
| 3,699,013 | 10/1972 | Miyata | 204/32 R |

FOREIGN PATENT DOCUMENTS 1,614,690 9/1970 Fed. Rep. of Germany.

*Primary Examiner*—T. M. Tufariello
*Attorney, Agent, or Firm*—Kenyon & Kenyon, Reilly, Carr & Chapin

[57] ABSTRACT

Articles made of ferrous, non-ferrous and light metals and alloys thereof, e.g., aluminum, beryllium, magnesium, molybdenum, steel, tantalum, titanium, tungsten, vanadium and zinc and their alloys, are pretreated before coating and surface finishing in an anhydrous, inert, aprotic liquid, and subsequently electroplated with aluminum, cadmium, indium or zinc in an aprotic organometal electrolyte essentially free of molecular oxygen and water and, optionally, additionally finished by anodizing, chemical oxidation or diffusion. The pretreatment may be by erosion with finely-divided abrasive particles suspended in such liquid and impinged upon the surface of the article by hydraulic jetting, or with an aprotic liquid by the liquid-drop erosion method. Alternatively, the pretreatment may be by electrolytic action in a circuit where the article serves as the anode and is immersed in an anhydrous, aprotic electrolyte. Articles so pretreated and electroplated are thereafter more readily surface-finished or mechanically shaped.

1 Claim, No Drawings

METHODS OF COATING AND SURFACE FINISHING ARTICLES MADE OF METALS AND THEIR ALLOYS

This is a division of application Ser. No. 300,906, filed Oct. 26, 1972, U.S. Pat. No. 3,969,195, which is a continuation-in-part of application Ser. No. 249,279, filed May 1, 1972, now abandoned.

This invention is directed to the art of electroplating and surface finishing articles of metals and their alloys, and more specifically is directed to pretreating the surface of such an article before electroplating it with aluminum, cadmium, indium or zinc, after which it may be further surface-finished, such as by anodizing, or mechanically shaped, as by drawing or stamping.

The coating and surface finishing of articles made of light metals, particularly beryllium, magnesium, aluminum, titanium and zinc and their alloys, is often necessary, because they are relatively base metals whose surfaces rapidly develop a fundamentally oxidic coating when exposed to the atmosphere. Such as oxidic coating usually protects the underlying metal against further corrosive attacks. However, the surfaces of articles made of such metals properly cannot be finished or coated in aqueous or protic media, due to the characteristics of the metals and oxide coatings.

Attempting to remove the oxidic coating by means of sand blasting causes the immediate formation of a new oxide coating in relatively base, oxygen-affinitive metals, due to the ambient air, and this oxide coating makes difficult or even prevents subsequent electroplating. This is a major disadvantage, since the excellent mechanical properties and the low specific weight of these metals make their utilization increasingly important in the construction of air-and space vehicles and automobiles.

The effect of corrosion protection depends very largely on the degree of purity of the metal, and, in alloys, on the type of alloying constituents. Generally, the rate of corrosion will decrease as the degree of purity of the metal increases. Alloying constituents should not be selected only with respect to their favorable influence upon the corrosion behavior of the base metal but, most of all, with respect to the improvement they impart to the mechanical, processing and casting characteristics of the base metal. Iron that is kept extremely pure through zone pulling and suspension melting will virtually not corrode in moist air.

"Electron metal", which is an alloy with 90% and more of magnesium and, depending on usage, including varying amounts of aluminum, zinc, manganese, copper and silicon, can be processed very easily by machining, but quickly becomes subject to atmospheric corrosion. The die-casting aluminum alloys which are particularly desirable for manufacturing, such as the alloys conventionally denominated DG AlSi10(Cu), DG AlSi12 and DG AlSi6Cu3, cannot be finished by anodizing or, if anodized, will result in an unsatisfactory quality and have an unsightly gray color.

Beryllium and beryllium alloys which are preferred modern construction materials due to their excellent strength at a very low (1.86) specific weight lack a dense, adhering and non-toxic surface-protection film to protect them against severe corrosive attack.

Titanium and titanium alloys find increasingly greater use in air-and space vehicles, as well as in machinery construction and in the chemical industry, because of their excellent mechanical properties at a relatively low (4.51) specific gravity. Their quickly developing, thin oxide coating (rutile) provides excellent corrosion protection in oxidizing media. Although this oxide coating can be increased in thickness through anodic oxidation, it has in contrast to the eloxation coating of aluminum (created by anodizing), a deeply violet to bluish-red color and does not possess the honeycomb structure which is inherent in the colorless eloxation layer of aluminum and which provides the superior penetration (advantageous for dyeing or staining) and solidification (sealing) properties of the eloxation coating. Also, articles of titanium do not attain the bright color hue and the good electrical conductivity of aluminum.

Zinc and zinc alloys also develop oxidic protective layers on the surface, under the effect of atmospheric influences, which protect the underlying metal from further corrosion. In contrast to aluminum, no methods are now known for treating zinc that would permit reinforcing (thickening) the protective layer by anodic oxidation or make it possible to build-up oxide layers whose structure permits dyeing or staining.

Coating by electroplating and surface finishing of the aforementioned light metals in aqueous or protic electrolyte baths is greatly impeded by the very rapid development of oxide or hydroxide surface coating in air or in aqueous hydrous pretreatment and electrolyte media. The surface coatings which are always present in aqueous media prevent or at least greatly complicate the direct electroplating of the basic metal without proper pretreatment and impair the electro-crystallization, the adherence, and the homogeneity of the additional metal added by electroplating. As a result, electroplating articles made of light metals, especially of beryllium and magnesium, from aqueous electrolyte media remains an unsolved problem. Most of all, the electroplating of aluminum and its alloys with other metals still causes considerable difficulties.

It also is known that the mechanical forming of materials by drawing, deep-drawing, extruding, pressing, embossing, stamping, squeezing, rolling, etc., can be facilitated and improved through the use of auxiliary substances such as drawing soaps, pastes, fats, oils, lubricants and the like, and that considerable advantages as to production and economy can be obtained through the choice of suitable auxiliary agents for the material and the tools.

Coating of the material to be formed with metal can be of advantage in the forming process. According to the discussion in the paper "Technology of the Hard Superconductors" by H. Hillmann in Zeitschrift fuer Metallkunde, Vol. 60, No. 3, particularly at pp. 162 and 164 (1969), for instance, wire material coated with copper shows better than 99% cold forming of a niobium-titanium alloy, which in itself is very hard and almost brittle.

It has now been found that the shaping of articles made of ferrous, non-ferrous heavy- or light-metals can be facilitated considerably if the substrate metal has been electroplated with high-purity aluminum, zinc, cadmium or indium. The formability of the metal is considerably improved, and at the same time its surface is protected and upgraded with respect to the properties which are of technical interest. Shaped articles which have been electroplated according to the invention and which have been formed by drawing, embossing, pressing and stamping, as well as by squeezing, rolling and by explosion methods, possess the mechanically and technologically advantageous properties of the substrate metal, such as high strength, magnetism and high electric conductivity, together with the particularly useful surface properties of the named electroplating metals, such as for instance, corrosion protection, ultrasonic weldability and solderability, anodic and chemical oxidation, which can be combined with further possibilities for surface finishing. In the case of rolling, squeezing and explosion forming processes, the electroplated coatings fulfill a function which saves and protects the substrate metal and ideally transmits forces due to work hardening.

Metals, particularly ferrous and heavy metals, provided with an electroplated coating in accordance with the invention as an auxiliary forming agent can be deformed to a greater extent than heretofore. The drawing properties, for instance, can be improved. Articles with thinner walls can be produced, and it becomes possible to work metals which heretofore could be shaped only with difficulty or not at all. Because of the unusually high ductility of the above-mentioned electroplated metals, the problem of cutting and stamping edges becomes manageable, with proper design of the tools, through coating and compression welding.

Accordingly, it is an object of this invention to furnish a process by which light metals and alloys of them may be first pretreated to remove surface layers of oxides and/or scale and thereafter electroplated with a thin coating of aluminum, by which process the light metal article is provided with a tightly adherent, uniform layer of highly pure aluminum.

Another object is to furnish a process by which light metals, especially beryllium, magnesium, titanium and zinc, may be coated with a thin coating of aluminum and thereafter anodized to furnish an eloxal coating on the surface thereof.

A further object it to furnish a process by which metals, particularly ferrous and non-ferrous heavy metals, may be coated with a thin coating of aluminum, cadmium, indium or zinc which facilitates the subsequent mechanical shaping of the coated metal.

Broadly stated, in a process of electroplating with aluminum, cadmium, indium or zinc, an article made of a ferrous or a non-ferrous heavy- or light-metal or an alloy thereof, the invention is the improvement of pretreating the surface of such an article with an anhydrous, aprotic liquid for the purpose of removing scale and exposing bright metal, and subsequently electroplating the article with aluminum, cadmium, indium or zinc in an aprotic electroplating electrolyte. The pretreatment is advantageously done by eroding the surface of said article with finely-divided abrasive particles suspended in such anhydrous aprotic liquid, which may be, for example, a normally-liquid hydrocarbon, a halogenated hydrocarbon, a perhalogenated hydrocarbon or a silicone oil, or an appropriate mixture of them. The liquid may be impinged against the surface of the metal by hydraulic jetting under high pressure, or by the liquid drop impact erosion technique. Alternatively, the surface pretreating may be done by passing an electrical current through the article electrically connected to operate as the anode of the circuit, while it is immersed in an aprotic electrolyte essentially devoid of water and molecular oxygen. Thereafter, the article is electroplated in an aprotic electroplating electrolyte. The electroplating electrolyte optionally may be one having the general formula $MX_nAlR'R''R + (m)$ solvent, as described hereinafter. The electroplating may be conducted employing a pulsed current and cyclical polarity reversal. The article is protected from exposure to moisture and oxidizing conditions after being pretreated and until it has been electroplated. After electroplating, the article may be provided with an eloxal coating, optionally later stained with dye, by anodizing. Also, it may be surface-finished by chemical oxidation or metal diffusion techniques.

(As used herein to refer to the pieces of metal being treated in accordance with this invention, "article" refers broadly to metal (including alloys) in various stages of fabrication into an article of manufacture, and may be in the form of sheets, bars, slabs, strips, moldings, die castings, stampings, extrusions, and the like, and assemblages of two or more pieces joined together.)

It has been discovered that the surface of articles of metals and their alloys can be electroplated with an adhesive, homogeneous and dense coating, if the surface of the article is first pretreated in an anhydrous, inert aprotic liquid and subsequently electroplated in an aprotic, organo-metal electrolyte which is substantially devoid of water and molecular oxygen, and, optionally, further surface-finished.

The pretreatment according to the present invention in aprotic organo-metal electrolyte media, free of oxygen and water, produces bright light-metal surfaces, free of surface films, which do not corrode, thereby allowing an ideal, immediate deposition of the protective metal upon the surface of the light metal.

When necessary, the surface treatment of the articles may be effected under the exclusion of air in an atmosphere of inert gas. This provides a bright surface without surface film for these metals which would otherwise react in aqueous or protic media or when exposed to air, and develop oxide-hydroxide or salt-like surface films which would prevent further electroplating, or at least interfere therewith, and reduce or impair the adhesiveness of the protective metal being plated onto the surface.

The above-mentioned electrolytic metals, which are relatively soft by nature, when electroplated on the surface-treated substrate metals under oxygen- and water-free conditions are strongly adherent, with a purity of better than 99.99%. The strong bonding to the base material, which is necessary if the electroplated metal is to serve as an auxiliary forming agent, is thereby assured. Functional coatings such as, for instance, copper or nickel, may already have been applied to the substrate metal to facilitate solderability. The auxiliary-layer or electrodeposited-metal layer, respectively, can also be joined to the substrate even more intimately prior to forming by a heat treatment, by virtue of diffusion processes. Because of the considerably higher purity of the metals electroplated on the surface of the substrate from the aprotic, oxygen- and water-free, organometallic electrolytic media, particularly advantageous surface properties are obtained, and at the same time a coating is created which is valuable from the viewpoint of possible uses of the coated article.

The process may be applied to light metals, such as aluminum, beryllium, magnesium and titanium, and to ferrous and non-ferrous heavy metals such as, for instance, titanium, zirconium, hafnium, vanadium, niobium, tantalum, molybdenum, tungsten, rhenium, or in general, materials which exhibit sufficient plasticity to be worked by one of the mechanical forming processes mentioned above and which have sufficient electrical conductivity or can react at their surface so that they can be cathodically coated in aprotic, oxygen- and hydrogen-free electrolytic media. Even though the advantage of the method according to the invention is particularly great in connection with aluminum-plated ferrous materials, the advantages of better formability and surface finish also exist with a coating of electroplated cadmium, zinc and indium.

In the following text, electroplating of aluminum onto light metals will be described illustratively.

In a preferred embodiment of the present invention, the pretreatment is effected by hydraulic jets having abrasive particles suspended in oil or other inert liquids, such as, e.g., paraffin oils, high-boiling hydrocarbons, chlorinated hydrocarbons, silicone oils, and the like. A specific system employs a light oil and corundum powder having particle sizes between about 50 and 200 microns, with jet pressures between about 1 and 10 atmospheres gauge, preferably 3 to 7 atm. As a propulsion means, the oil itself can be circulated or accelerated with compressed air or an inert gas, such as nitrogen. The abrasive particles may be corundum, silicon carbide, glass beads, and the like.

The hydrophobic liquid film which surrounds the abrasive particles displaces air and moisture during its impingement upon the metal surface to be cleaned, so that the abrasive particles break through the oxide surface layer within the liquid film and expose the bare metal surface, which is being protected by the liquid film against the access of air and moisture.

The pretreatment according to the method of the present invention is a relatively gentle mechanical treatment of the surface of the article. The surface removal takes place within a range of only a few tenths to a few microns of layer thickness. Thicker oxide and scale layers can be removed beforehand by sand blasting or by chemical pretreatment. This is not required, however, for newly processed greased or oiled articles. The oxide layers which also develop at room temperature on dry surfaces of light metals can also be directly removed by hydraulic jets with abrasive particles suspended in oil. It is a particular technical advantage of this invention that greased articles can be immediately subjected to the surface pretreatment described herein.

The surface-finishing method of our invention, which is suitable for all materials, has the following processing steps, when conducted by means of hydraulic jets:

1. mechanical fabrication of the article;
2. pretreating the surface of the article with a hydraulic jet of an abrasive suspended in an aprotic liquid, preferably oil;
3. removing an oily or greasy film, if any be present, from the article by immersion into a suitable solvent, such as perchloro-ethylene (sometimes denominated PER);
4. thereafter completing the de-greasing by PER vapor de-greasing;
5. promptly immersing or rinsing the article in toluene, optionally with ultra-sonic vibration; and;
6. promptly immersing the article into the electrolyte bath employed for electroplating.

By routine experimentation varying the type and size of the abrasive particles, the viscosity of the aprotic liquid, and the jet pressure, suitable operating conditions can be obtained for each metal and each surface characteristic, and bare metal surfaces, free of surface filing, can be obtained.

It is noteworthy that this embodiment of pretreating surfaces requires few process steps and works without the need of aqueous etching and rinsing baths and therefore also eliminates waste water disposal problems.

The surface pretreatment according to the invention may also be effected through liquid-drop impact erosion, with inert, anhydrous, aprotic liquids. Such a method is described, for example, in German Pat. No. 1,614,690. This embodiment of surface treatment is particularly suitable for strip and sheet material for continuous operation and represents the method that is most suitable ("best matched") to the material being treated. It is characterized by the following process steps:

1. manufacturing sheets or strips of the metal to be treated, optionally wound on a reel or drum for feeding into the process;
2. pretreating the metal by liquid-drop impact erosion (in which the drops of liquid fall under the influence of gravity) with benzene or toluene, optionally after preheating the metal; and
3. immersing the metal into the electrolyte bath employed for electroplating.

For safety reasons, the liquid-drop impact erosion is conducted in an atmosphere of gaseous nitrogen or perhalogenated hydrocarbons.

The aforementioned advantages also apply to this procedure.

A third suitable surface pretreating method is the anodic removal of a thin surface layer of the light-metal article in an aprotic organo-aluminum electrolyte medium, more particularly, in electrolytes containing aluminum ethyl and/or aluminum methyl. The ethyl or methyl radicals which are generated at the anode during the passage of current, dissolve the light metals into liquid metal alkyls ($MR_n$):

$$Be + 2\,R. \rightarrow BeR_2$$

$$Mg + 2\,R. \rightarrow MgR_2$$

$$Zn + 2\,R. \rightarrow ZnR_2$$

$$Al + 3\,R. \rightarrow AlR_3$$

$$Ti + 4\,R. \rightarrow TiR_4$$

While articles made of beryllium or aluminum may also be anodically dissolved in aluminizing electrolyte media containing halides, particularly hydro-fluorides, this cannot be done with articles made of magnesium or zinc, because of the formation of insulating surface layers of a metal halide, especially $MgF_2$ or $ZnF_2$. Electrolytes suitable for effecting anodic pretreatment of any of the light metals referred to herein are the tetra-alkyl alanate-complexes which are free of halide ions, e.g.:

$$Na[Al(C_2H_5)4],\ Na[Al(CH_3)_4],\ R_4N[Al(C_2H_5)_4].$$

The mixed sodium-potassium salts of the tetraethylalanate, which melts at 70° C, is particularly advantageous. The sodium salt first melts at 128° C. Light metal articles which are anodically treated in these molten electrolytes and thereby pretreated with respect to their surface, may be immersed under inert gas into the electroplating cell, still wet with the pretreating electrolyte, and electroplated with aluminum by means of cathodic action.

With articles made of beryllium and aluminum, the anodic surface pretreatment can be carried out directly in the electroplating cell and the bare metal surface can be electroplated with aluminum by means of polarity reversal. This particularly favorable embodiment of the surface pretreatment method in an aprotic electrolyte medium, free of water and oxygen, comprises the following steps:

1. vapor-degreasing with PER the article to be treated and draining excess liquid from its surface;
2. washing, or rinsing, the article with toluene, optionally with ultra-sonic vibration;
3. immersing the article, wet with toluene, into the electroplating bath, electrically connecting the article as the anode of the circuit, and anodically charging it for a time, about 15 min., sufficient to remove the surface film or scale, optionally with concurrent movement (sometimes referred to in the electroplating art as agitation) of the article; and,
4. reversing polarity and electroplating aluminum onto the surface of the article.

When articles comprising magnesium, zinc or titanium are treated, process steps 1 and 2 are first conducted. Thereafter, the article, wet with toluene, is immersed into the molten pretreatment electrolyte bath of 80° to 100° C bath temperature, consisting, e.g., of a 1:1 mixture of $Na[Al(C_2H_5)_4]$ and $K[Al(C_2H_5)_4]$, and is anodically stressed for a short period in order to loosen and remove the surface film and scale. Subsequently, the article is immersed, wet with pretreatment electrolyte, directly into the aluminizing bath, under inert gas ($N_2$), and the cathodic aluminizing electroplating process is conducted, accompanied by electrode agitation.

Besides these surface pretreatment methods, one can apply methods which produce bare surfaces, free of surface films, in other ways and which permit a moisture-free immersion of the article into the aluminizing bath, such as structural components freshly machined under oil, from solid material, that can be placed into the aluminizing bath, following PER degreasing and washing in toluene.

According to the invention, the aluminization by electroplating can be carried out with aprotic organoaluminum electrolyte media, free of molecular oxygen and water, preferably with electrolytes containing an aluminum alkyl. The use of special current and electrolysis conditions, particularly pulsed current with polarity reversal cycles, may have a favorable influence upon the type of deposition of the electrodeposited aluminum. The particular type of electro-crystallinity produces a dull, glare-free surface. Normally, the deposition current density is in the range of 10–20 mA/cm$^2$. Good electrodeposition can be obtained even up to 60mA/cm$^2$. At higher current densities, an intensive movement of the cathode or of the electrolyte is preferable, particularly for the disipation of the Joulean heat which is released.

On principle, all organoaluminum electroplating electrolytes which correspond to the following general formula are suitable for carrying out the method according to the present invention:

$$MX.nA1R'R''R + m \text{ solvent}$$

where M can be $Na^+$, $K^+$, $Rb^+$, $Cs^+$ or a quanternary onium ion with N,P,As or Sb as the central atom or a tertiary onium ion with S, Se or Te as the central atom; X is preferably $F^-$ or $Cl^-$ but also $Br^-$ and $I^-$, $CN^-$, $N_3^-$ or $\frac{1}{2}(SO_4)^{2-}$; *n* is greater than unity, preferably 2 to 3; and R is always an organyl radical, preferably an alkyl radical, more particularly ethyl or methyl radical; R′ may be the same as R, but may also be an hydride ($H^-$) radical or an halide ($F^-$, $Cl^-$) or other monovalent negative ion (e.g., $CN^-$, $N_3^-$); R″ is selected from the same class of radicals as is R′ and on any specific molecule of the complex, may be the same as or different from R′; and *m* (mols) may be in the range of 0–5. Suitable solvents are, e.g., aromatic hydrocarbons, particularly toluene and xylene, and ethers, preferably higher-boiling ethers, such as tetrahydrofuran, dipropyl-dibutyl ether, dioxane, etc. Electrolytes of this type are disclosed, for instance, in German Pat. Nos. 1,200,817 and 1,236,208. The organo-aluminum electrolytes may be used alone, or in a mixture. In order to increase their conductivity, they may be diluted with aromatic hydrocarbons, e.g., toluene.

The upper limit of the bath temperature during electroplating is determined by the thermal stability of the electrolyte and the boiling point of the solvent if any is used. It is above 130° C.

Metal being coated with aluminum acquires an adhesive coating which is very pure and therefore bright like silver, exceptionally ductile and corrosion-resistant. This coating is produced in the absence of oxygen and moisture as well as corrosive media, and thus does not contain interfering intermediate layers. The thickness of the electroplated coating is normally in the range of about 10 to 30 microns. Due to these advantageous characteristics, it is called "galvano-aluminum". Because of its high degree of purity of at least 99.99% aluminum, this galvano-aluminum always provides, regardless of the peculiarities of the base material of the molded bodies and structural components, a high degree of corrosion protection and a silver-bright, very decorative appearance; hence it represents a true surface finish. This applies equally for beryllium, magnesium, titanium and zinc as well as for aluminum articles. In addition, galvano-aluminum layers have very good electrical surface conductivity, superior ultrasonic weldability due to their high ductility (20 kg of force/mm$^2$ HV; equal to 200 Newton/mm$^2$HV), and high reflectivity after burnishing or polishing. The high ductility of the galvano-aluminum lends the structural components of high strength, hard materials, particularly beryllium, magnesium and titanium alloys, a good sliding surface and a metal-to-metal sealability with appropriate contact pressure.

Furthermore, the components electroplated with aluminum have excellent properties for anodizing. This expands the possibilities for surface finishing the galvano-aluminum-coated light-metal articles to a particularly large degree. In addition to the corrosion protection resulting from the silver-bright but relatively soft galvano-aluminum plating there is also the corrosion-protection by the crystal-clear, transparent and wear-resistant galvano-aluminum eloxation layer which is surprisingly hard (over 4000N/mm$^2$HV) and which protects the surfaces of the article against mechanical damage. The protective layers which are produced by anodic exposure of the galvano-aluminum coating in the eloxation (anodizing) baths (which are known per se) in almost any desired layer thickness, owe their particular characteristics to the high purity of the galvano-aluminum. These characteristics are: exceptionally crystal-clear transparency, high homegeneity and hardness of the eloxal layer, good insulating properties and heat conductivity, the clear-color dye-ability and stainability of the eloxal layers produced in GS baths, and very good hardening (or sealing) characteristics of the galvano-aluminum eloxal layers from GS and GX eloxation baths.

In accordance with a preferred embodiment of the invention, the aluminum coated articles are anodized as an after-treatment. When the above-indicated, specific requirements for the current and the electrolyte for the deposition of the aluminum are adhered to, a dense and perfect anodic oxidation is obtained with the methods commonly used in industry. The resulting GS eloxal layers can subsequently be dyed and solidified (sealed).

If dyeing is not desired, the solidification (sealing) is carried out with boiling water above 95° C, or with superheated steam.

The crystal-clear eloxal layers obtained when the article is pretreated and electroplated according to the method of the present invention are characterized, particularly, by extreme hardness (400 kg/mm$^2$ HV;4000 Newton/mm$^2$HV) and wear-resistance. They can be dyed with color-clearness and be printed on. They also have good thermal conductivity with a high insulation resistance and a high corrosion-protection capability and can readily be polished by mechanical means.

In some cases, when corrosion protection is desired irrespective of the decorative surface appearance, yellowish or greenish protective layers can be produced in the galvano-aluminum coating by conventional chemical oxdiation methods, such as, for instance, the chromatizing method. In other instances, for example with titanium and titanium alloys, a particularly hard titanium-aluminide layer can be produced by diffusing in the electro-deposited aluminum layer.

Some of the special characteristics of aluminum which are responsible for its wide technical application can thus be applied on surfaces of other metal articles. For example, the dyeing properties (inherent only to aluminum) of the layers which can be produced by anodizing in GS baths, can be applied to other metals and to the gray or black eloxalized aluminum alloys. The surface oxide-layers of beryllium, magnesium, titanium and zinc articles cannot be dyed.

A particular advantage of the present invention lies in the fact that light metals and alloys, particularly beryllium and magnesium and high-alloy aluminum which are particularly suitable for mold-casting, extrusion or die casting procedures because of their high strength and good machinability, or their excellent workability, can be provided with the excellent surface characteristics of high-purity aluminum, the galvano-aluminum coating. A coating according to our invention provides not only durable corrosion protection but very often makes possible the application of these metals in technology. Thus, for example, magnesium and magnesium alloys could not heretofore be electroplated.

A further, very particular advantage of the invention resides in the fact that the electroplated metals exhibit a very effective sliding and lubricating effect. Electroplated aluminum has a Vickers hardness of less than 200 N/mm$^2$ HV and is therefore more than three times more ductile (or softer) than gold. Contaminating lubricants and forming additives become unnecessary. If materials electroplated according to the invention with aluminum, zinc, cadmium or indium are used, the service life of the tools for the drawing, pressing, embossing and stamping operations is considerably increased, by up to 50%.

The coating of electroplated metal therefore not only makes possible and facilitates the mechanical forming in the fabrication process mentioned above as a soft, ductile, adherent and gently force-transmitting auxiliary agent, which makes other auxiliary substances of the conventional kind unnecessary because it provides a dry sliding and lubricating film and thereby increases the useful tool life considerably, but constitutes at the same time an effective surface finish which provides corrosion protection for the normally less noble substrate metal, imparts higher electric conductivity, excellent weldability and solderability and presents a metallic, bright and possibly brilliant decorative appearance.

Depending on the peculiarity of the electroplated metal applied, the following surface properties or surface finishing possibilities can be listed in addition to the properties which are effective for forming, namely,

- electroplated aluminum, which is especially ductile from room temperature to 660° C;
- electroplated zinc, which is especially ductile from 80° to 160° C;
- electroplated cadmium, which is especially ductile from room temperature to 321° C;
- electroplated indium, which is especially ductile from room temperature to 156° C;

where approximately the following order applies regarding softness of the electroplated metals:

$$In > Cd > Al > Zn,$$

and the bondability to the substrate metal in the forming process (in the manner of compression or friction welding) increases from zinc to indium to cadmium to aluminum.

Due to its high purity of over 99.99%, electroplated aluminum exhibits a strong corrosion protection effect, which can be enhanced further by anodic oxidation to form eloxal layers. These can be sealed, are insulating, can be dyed and printed, and are extremely hard and abrasion resistant. The electroplated aluminum layer as well as the electroplated aluminum eloxal layer makes a good adhesion base for paints and adhesives. It has a silver-bright appearance, can be polished and burnished and has very good thermal and electrical properties, excellent ultrasonic weldability and solderability. Good bonding possibilities by friction and compression welding exist. It is highly suited for subsequent diffusion processes (aluminide formation).

Electroplated zinc has a metallic, bright appearance and also exhibits a good corrosion protection effect, which can be enhanced further by chemical oxidation, for instance, by chromatizing. The zinc layer constitutes a good adhesion base for paints and lacquers, and is well suited for soldering.

Electroplated cadmium is distinguished particularly by a good corrosion protection effect for ferrous materials. It forms a useful adhesion base for paints and lacquers and is highly suited for soldering. It is also suitable for ultrasonic welding. As it is suited as a base for chromium plating, protection of the rather soft cadmium against mechanical damage being best brought about by chromium plating, and at the same time, excellent protection against corrosion is obtained.

Electroplating with indium is particularly well suited for friction and compression welding.

It should also be emphasized that the galvano-aluminum deposition may be done in the complete absence of hydrogen. This factor is of particular importance among the light metal metals being discussed here; e.g., titanium absorbs into its metal lattice hydrogen present in statu nascendi, thus changing its mechanical properties in an adverse manner. The hydrogen embrittlement and stress corrosion induced thereby cannot occur in electroplated materials; this is an extremely important advantage of the galvano-aluminum coating. The metal deposits occurring from aqueous electroplating baths are almost always accompanied by a rather strong hydrogen evolution, which at the same time reduces the cathode efficiency. The galvano-aluminum deposition takes place without generation of hydrogen with a cathode efficiency of almost 100% of theoretical.

The method of the invention can be used for coating or for surface finishing various molded bodies of base, oxygen-affinitive metals. Surface protection with a desirable decorative appearance may be obtained; this is important particularly for components used in dentistry, electronics, in the automobile industry, as well as in air and space vehicles. Due to its high ductility, the galvano-aluminum plating can also be used as a sliding and lubricating film. Furthermore, surface brightness (luster) can be provided by mechanical means, as for example by buffing, or also by barrel polishing. The shiny surfaces can be protected against mechanical damage by subsequent anodizing. A further advantage of the high ductility of the aluminum coating is also found in the bonding technique of ultrasonic welding. The galvano-aluminum eloxation layers make it possible to finish the surface of handles, front panels, substrates and die castings. Moreover, the galvano-aluminum eloxation layer forms an ideally adherable base on the surface of the light metal articles for painting, plastic coating, cementing and impregnating.

For continuously operating aluminizing installations, for instance, for wire and strip run-through installations, the procedures of electropolishing, known per se, (there are available electrolytes for ferrous materials, non-ferrous metals and aluminum materials, and others) with subsequent intensive washing, water displacement (by means of dewatering fluids) and wetting with toluene can also be used to advantage for producing and retaining a pure, bare surface which is also protected against renewed oxidation. Particularly in ferrous materials, the so-called surface cleaning with copper flash (less than 0.5 micron of copper layer) in an aqueous system, with washing and water displacement, may be employed in addition to the methods described above. For the organophilic beryllium, magnesium, zinc and aluminum materials, the surface pretreatment by anodic loading in aprotic, oxygen- and water-free organometallic, perferably organo-aluminum electrolytic media, has been found to be particularly suited.

The layer thickness to be chosen for the electroplated aluminum depends primarily on the intended extent of deforming of the substrate metal, and secondarily on the desired thickness of the eloxal layer. Also the hardness or ductility, respectively, of the substrate and the speed of forming have an influence on the required or optimum layer thickness of the electroplated coating.

In case the electroplated coating is needed only as the auxiliary forming agent and its presence on the surface of the formed part is undesirable, the coating can be removed again by mechanical, chemical or electrochemical means.

By the method according to the invention, drawn, pressed, embossed and stamped parts and parts produced by squeezing, rolling or explosion methods, which heretofore have been made preferably of light and non-ferrous metal materials such as, for instance, brass or copper, may also be made of ferrous materials. In particular, sections of steel strip can be coated on both sides with electrodeposited aluminum, zinc, cadmium or indium.

Aluminum has the greatest importance among the electroplated metals mentioned because of its special properties and its favorable melting point of 660° C, and, not least, because of its low price. For this reason, the advantages and possible applications for mechanical forming processes and surface finishing attending the electrodeposited aluminum coating will be illustrated in the following examples; the same or similar procedures are also possible with the other electroplated metals and lead to analogous results.

The invention will be described in greater detail in the following Examples:

EXAMPLE 1

Electro-Aluminizing Of Beryllium Discs 2 mm-thick beryllium discs of 40 mm diameter are arranged in a cathode frame consisting of titanium, fixed at the lateral edge with small dovetail pins, and contacted. Following PER vapor-degreasing and drying, the arrangement is placed, wetted with toluene, into the aluminumizing electrolyte comprising trimethyl-benzylammonium-hexaethylmonochlorodialanate with an excess of 0.2 mol of Al-triethyl, in toluene (1:3) and is anodically plated at 80° C for 15 min. with intensive agitation of the electrolyte media. Then the polarity is reversed and, at a current density of 11 mA/cm$^2$, accompanied by further electrolyte agitation, a galvano-aluminum layer of about 15 micron thickness is deposited in 90 min. The discs are removed from the aluminizing cell, the adhering electrolyte is rinsed off the discs with toluene, which are then briefly dipped into TRI-NORM "Al" and washed in water, and thereafter dried with acetone. The galvano-aluminum coating has a bright fine-crystalline appearance.

The beryllium material is coated with tightly adhering, galvano-aluminum. The galvano-aluminum layer may be anodized, and further surface refining such as dyeing, marking, printing, lettering, cementing, etc. may be carried out.

EXAMPLE 2

Electro-Aluminizing, Anodizing and Dyeing Of Beryllium Blocks

In a titanium cathode frame, four beryllium blocks (6×6×16 mm) are fixed above their square end faces with two titanium contact tips and hydraulically surface-treated with 70 micron fine electro-corundum particles suspended in a 1:1 mixture of paraffin oil-silicone oil at a jet pressure of 6 atm. Subsequently, they are washed at once in a PER immersion bath, degreased in a PER vapor bath and rinsed in toluene. Wet with toluene, the beryllium blocks are lowered under dry nitrogen gas into the aluminizing cell, the electrolyte of which is $Na[(C_2H_5)_3AlFAl(C_2H_5)_3] \cdot 3.4\ C_6H_5CH_3$. At an electrolyte bath temperature of 95°–100° C, electrodeposition of aluminum takes place under mechanical cathode agitation, with a current density of about 10 mA/cm$^2$. After 3 hours, with a polarity reversal cycle of 4:1, a galvano-aluminum layer of about 30 microns thickness is plated on the surface of the blocks. It is highly adherent and homogeneous. The adhering electrolyte is removed from the blocks by washing in toluene, blow-drying and brief immersion into TRINORM "Al".

With the same arrangement of the beryllium blocks in the titanium frame, the anodizing process is carried out immediately thereafter at 18° C in a GS (direct-current, sulphuric acid) anodizing bath. Within 35 minutes, a colorless, crystal-clear galvano-Al-eloxation layer of approximately 12 microns thickness grows on the surface.

Prior to solidification of the eloxal layer in boiling deionized water for about 30 minutes, a coated block is dyed in a staining solution of 5 g/liter of a dye known as Aluminum-True-Red B3LW (available from SANDOZ AG, Basel) for 10 min. at room temperature. While the uncoated beryllium blocks have a blue-grey surface color, the unstained anodized blocks, coated with a galvanoaluminum - eloxation layer, have a matte silver-bright hue.

In the same manner which applies to pure beryllium, molded articles of beryllium alloys, particularly high-percentage beryllium-aluminum alloys with 48 to 52% beryllium content, can be coated and stained or dyed, printed-on or lettered. Suitable dyes are, for example, the Aluprint dyes available from SANDOZ AG, Basel.

EXAMPLE 3

Electro-Aluminum-coating of Cylinders Of Magnesium Alloy

Two cylindrical pieces of 70 mm diameter and 100 mm length consisting of magnesium alloy are attached in a rotating holder of Ti rods, and their surfaces treated by means of pressure jets with 80 micron glass beads in PER at a jet pressure of 6 atm. After spraying with hot PER and, finally, PER vapor, the still-hot parts, together with the rotating holder, are immediately lowered into the 100° C aluminizing bath and aluminized between two Alanode plates (space about 15 cm) with a cathode movement rate of 10 cm/sec and rotation of the parts. The current source is a pulse generator which, at a cathode/anode polarity reversal cycle of 4:1 (rectified value of cathode current, 12A; of the anode current, 3 A) and 50 Hz. deposition frequency, at about ± 5 V deposition voltage (amplitude height), applies an average current density of about 15 mA/cm$^2$ to the objects to be aluminized. In 2 hours of plating time, a silver-bright, pore-free and tightly adhering galvano-aluminum coating about 30 microns thick is obtained on the cylinder surface. The cathode frame, withdrawn in a dry nitrogen atmosphere from the aluminizing bath, together with the coating magnesium cylinders, is sprayed with toluene and thus cleansed of the adhering electrolyte. In the same manner, any desired magnesium materials which are frequently used because they are easy to work by casting, can be provided with an aluminum layer, which further increases the usefulness of these light metals.

EXAMPLE 4

Electro-Aluminizing, Anodizing And Staining Of Bars Of Electron Metal, Containing 90% Or More Of Magnesium and Minor Amounts Of Aluminum, Zinc, Manganese, Copper And Silicon In a 300×500 mm titanium cathode frame of an 80-liter aluminizing cell, 8 pieces of electron metal bars of 135×26×16 mm, with longitudinal slots of appr. 1 mm width and 0.5 mm depth, are fixed in two rows by means of titanium point-contacts over the cross-sectional area. After intensive PER vapor degreasing and rinsing with toluene in an ultrasonic bath, the toluene-moistened parts are subjected in a protective nitrogen atmosphere to surface pre-treatment. The electrolyte bath was molten (90°–100° C) 50% $Na[Al(C_2H_5)_2]$ and 50% $K[Al(C_2H_5)_4]$. With the electrolyte circulated by stirring, the surface of the electron metal bars is anodically pre-treated for 15 min. at a current density of 18 mA/cm$^2$, and a surface film about 2 microns thick of magnesium is removed, together with the oxide surface layer. A nickel screen serves as the cathode. With a favorable arrangement of the pre-treatment bath, immediately adjacent to the aluminizing bath, the frame and work pieces, still wet with electrolyte, can be directly lowered, under protective nitrogen gas, into the aluminizing cell. Otherwise, the frame and the now-metallically-bare electron metal parts are rinsed with toluene and the toluene-wetted parts are transferred to the aluminizing bath.

In an 80° C plating electrolyte bath of $Na[(C_2H_5)_3Al\text{-}FA1(C_2H_5)_3]$ . 4.0 $C_6H_5CH_3$, the parts are coated, over a period of 2.5 hours, with a galvano-Al layer about 25 microns thick. The process is conducted at a cathode agitation rate of 6 cm/sec and 12 mA/cm$^2$ current density by means of a pulse current (5:1) and 25 Hz. After spraying with toluene, rinsing with hot water and dipping for a few seconds in TRINORM "Al", the aluminized electron bars are given an anodizing treatment in a GS bath at 18° C for 20 min. The resulting eloxation layer, fully transparent and about 8 microns thick, is dyed for 5 min. in a 60° C SANDOZ staining bath with Al-True Gold L(2 g/l) to a gold color and is solidified in boiling water for 30 min.

EXAMPLE 5

Electro-Aluminizing, Anodizing, Printing And Dyeing Of Die-Cast Zinc Articles Toy cars (approx. 60×28×20 mm) of die-cast zinc alloy, e.g., DG ZnAl4 or DG ZnAl4Cu1, are disposed at a distance of 20 mm in a frame with two titanium point-holders and are surface-treated by means of pressure jets with electro-corundum (70 microns) in viscous paraffin oil at a jet pressure of 5 atm. After washing in PER, degreasing in PER vapor and rinsing in toluene, the toluene-wetted frame with the cars is transferred under $N_2$ gas into the aluminizing electrolyte. With cathode agitation of 10 cm/sec, the die-cast zinc toy cars are coated on their outer surfaces under the current conditions stated in Example 3, resulting in an approximately 30 micron thick plated galvano-Al layer.

One half of the number of Zn die-cast parts are polished by means of barrel polishing with steel balls of 2 mm diameter, in a rotating polyethylene barrel and, subsequently, anodized in a GS bath of 15° C; the other half is directly subjected to anodizing without polishing.

For carrying out the anodizing treatment, the interior surfaces of the toy cars are coated with a masking paint that resists sulfuric acid and, thereafter, the outer area is coated with an eloxation layer of 15 to 20 micron thickness. The well-washed eloxation surfaces are then marked and printed with Alu-print "Black" color-paste (SANDOZ AG, Basel) and thereafter stained for 5 min. at room temperature in a SANDOZ color bath of Al- Blue LLW (3.5 g/l) and subsequently solidified in boiling water of pH 5.5 for 30 min.

In this manner, shiny as well as glare-free mat, wear resistant, printed and stained galvano-Al eloxation layer surfaces are obtained.

EXAMPLE 6

Electro-Aluminizing And Anodizing Treatment Of Hollow Cylinders Of Malleable Aluminum Alloys With the aid of threaded titanium supporting members, 5 columns each comprising 8 hollow cylinders (20 mm outside diameter, 54 mm long, 1.5 mm thick) of an aluminum alloy (AlZnCu 1.5 F53) are fixed upon one another and simultaneously contacted in the frame of an 80-liter aluminum electroplating cell. In the pressure-jet apparatus, the parts are surface-treated while being rotated with 6 atm. jet of micron corundum powder in paraffin-silicone oil. The parts, freshly machined, are delivered wetted with oil, and can be immediately treated, so that only a surface layer a few microns thick need be removed.

After PER washing, PER vapor degreasing and rinsing in toluene under ultrasonic action (about 5 min total), the pretreated cylinders, wet with toluene, are placed, via an inert-gas lock, into the aluminum electrolyte bath. At a cathode movement of about 13 cm/sec, the aluminizing is carried out for 1.5 hours, with a pulsed current of average current density of 12 $mA/cm^2$ and a polarity-reversal cycle of 4:1, at 50 Hz. The galvano-Al layer thickness is about 15 microns and has a fine-grained silver-bright appearance.

The anodizing process is performed, after washing with toluene, dipping into TRINORM "Al" and rinsing in water, in a GS bath of 18° C for 20 min. (17.5 V, 15 $mA/cm^2$) and a crystal-clear eloxation layer of about 6 microns is obtained. The layer is solidified for 20 min. in superheated steam of 110° C.

High-purity aluminum and Raffinal, which are usually the purest aluminum types technically available, are too soft for most technical structural applications and do not have enough mechanical strength. During attempts to machining them mechanically by drilling, milling, grinding and the like, they "smear" and warp. Their use in manufacturing is limited, except for pressing, stamping and rolling processes. Among the aluminum alloys, such as, for example, Al-Mg, Al-Cu, Al-Si and Al-Zn alloys which, due to their high strength, good mechanical workability and plasticity through hot-pressing, forging and casting, have attained substantial importance in automobile, ship and airplane construction, the minor alloy constituents and impurities, specifically Si, Mn, Cu, Fe, Pb, cause particular difficulties during anodizing because, e.g., of reduced hardness or their inherent (natural) color. As a result of the present invention, the same high-purity galvano-aluminum electroplated coating which has the valuable characteristics described above can be electroplated onto such alloys. The technology of aluminum applications is considerably advanced thereby.

EXAMPLE 7

Electro-Aluminizing Of Die-cast Perforated Aluminum Plates

In a titanium frame structure, 3 perforated plates (100 × 60 × 3 mm) of the aluminum alloy DG Al Si12, are fixedly disposed with Ti point contacts above their narrow edges, and surface-treated in a pressure-jet apparatus at a jet pressure of 5 atm. with electro-corundum (SN 120) suspended in oil. The subsequent washing and degreasing is done as in Example 6. The toluene-moistened parts are then electroplated with aluminum for 3 hours in a 100° C aluminizing electrolyte bath of triethylphenyl ammonium-chloride and 2,2 aluminum-triethyl, dissolved in an equal volume of toluene, at a cathode movement of 15 cm/sec and an aluminum anode spacing of 5 cm with a current density of 10 $mA/cm^2$.

EXAMPLE 8

Electro-Aluminizing And Masked Anodizing Treatment And Dyeing Of Aluminum Sheets Six sheets (100 × 50 × 2 mm) of 99.5% pure aluminum, are fixed in an insulated titanium frame structure in two rows above each other by means of Ti point contacts, and simultaneously contacted. The surfaces are degreased by etching with diluted caustic soda and are given a preliminary cleaning. After vigorous rinsing in water, the water is removed by dipping into acetone and thereafter toluene, then the Ti support-structure with the sheets, is immersed, under $N_2$ gas, into the electrolyte of $Na[(C_2H_5)_3AlFa1(C_2H_5)_3]$ . 3.0 toluene.

In order to remove the oxide-hydroxide outer layer that has developed through contact of the aluminum with water, the sheets are anodically charged (i.e., electrically pre-treated by serving as the anode of a circuit) for 10 min. The current density is 30 $mA/cm^2$. The Ti structure is moved back and forth at 15 cm/sec; the electrolyte (at 90°) is mechanically stirred. The oxide cover layer is thereby removed, together with a thin layer of aluminum.

Immediately thereafter and in the same electrolyte, the now-metallically-bare surfaces are coated in 55 min. with a tightly-adhering galvano-Al layer about 20 microns thick, employing polarity reversal with 20 $mA/cm^2$ average current density and the usual pulsed-current conditions (see Example 6). After washing with toluene, dipping in TRINORM "Al" and rinsing in water, drying is effected with the aid of acetone.

For anodizing only a portion of the surface, the rectangular faces of the aluminized sheets are covered in selected areas with self-sealing, acid-resisting plastic foil, cut in the shape of a design with cross-pieces 5 mm in width. The sheets are now anodized in a 15° GX (direct current, oxalate acid) bath for 30 min., and an eloxation layer approximately 12 to 15 micron thick is produced on the exposed surface parts and edges. After thorough rinsing in water, the adhesive foil is pulled off, the sheets are again washed and the GX eloxation layer is dyed in a SANDOZ color bath Al-black MLW (10 g/l) at 60° C for about 5 min. Finally, the eloxation layers which are dyed black are solidified in boiling water for a period of 30 min.

The surface of the thus-partially anodized sheets is not perfectly planar, because the surface of the eloxal layer is at a higher plane than the surface of that portion of the galvano-aluminum layer which was under the masking foil. The depressions in the surface may be filled in as follows. Since eloxation layers are not attacked during the anodic surface pre-treating process in the aluminizing electrolyte, but a surface layer of the galvano-aluminum could well be removed, the afore-described surface treatment can be repeated in the electrolyte and, thereafter, the galvano-aluminum surface which was under the masking foil can be thickened up to the level of the GX eloxation surface by means of polarity reversal by electroplating additional aluminum thereon.

EXAMPLE 9

Electro-Aluminizing Of Titanium Strip And Surface-refining By Aluminum Diffusion Strip titanium, e.g., type CONTIMET 30 or 35, 160 mm wide and 0.5 mm thick, is passed for surface pre-treatment and aluminizing on both sides through a strip aluminum electroplating apparatus which operates continuously.

The surface pre-treatment of the incoming titanium strip may be done by means of pressure jets with 100 micron silicon carbide particles suspended in trichlortrifluorethane (FRIGEN 113) or a higher-boiling fluoro-hydrocarbon at a jet pressure of 10 atm. with jet nozzles being directed to both sides of the strip and under nitrogen gas. Alternatively, it may be done by means of liquid-drop impact erosion with FRIGEN 113 (density of 1.58 g/ml) or a liquid perfluoro-hydrocarbon of greater density. In the first case, following surface pre-treatment with FRIGEN 113, the strip is washed free from particles and—in both instances—dried under nitrogen gas. The metallically-bare titanium strip then enters an aluminizing electroplating cell containing a suitable electrolyte and is coated on each side with about a 10 micron layer of galvano aluminum at a maximum current density of 60 mA/cm$^2$ within a passage time of 10 min. To realize this relatively high deposition rate, the cathode-anode spacing is reduced to 10 mm and the electrolyte liquid is rapidly pumped-over in counter current flow between the titanium strip (serving as the cathode) and both aluminum anodes.

The coated strip is rinsed with toluene and dried, and the galvano-aluminum, in a loosely wound state, is diffused at 600° C to a depth 5 to 10 microns in two hours.

The surface pre-treatment, aluminizing and diffusion are conducted in the absence of hydrogen.

By analogy, the titanium alloys which increasingly gain significance in turbine and motor construction, in rocket- and reactor technology as well as in aircraft construction, can be surface-refined. In the technically important titanium alloys, aluminum is the alloying component present in the greatest amount, e.g.:

| | |
|---|---|
| Ti Al Mo 8-1-1 | 7.5–8.5 % Al, |
| Ti Al Mo 74 | 6.5–7.3 % Al, |
| Ti Al 64 | 5.75–6.75 % Al, |
| Ti Al Sn Zr Mo 6-2-4-2 | 5.5–6.5 % Al, |

since aluminum increases the strength of the titanium. According to the method of the invention, the usually readily workable, unalloyed titanium types, can now be coated with galvano-aluminum. The diffusion of aluminum into the surfaces of the article produces particularly hard titanium-aluminum alloys. Sheets of titanium used for the construction of containers and for aircraft can thus be covered with a harder, wear-resistant surface which has better heat resistance. Electroplated galvano-aluminum and galvano-aluminum eloxation layers on titanium surfaces increase the protection against corrosion, particularly against salt water, and provide a functional and decorative surface refining of the steel-hard light metal.

EXAMPLE 10

Electro-Aluminizing, Anodizing And Dyeing Of Titanium Ti Alloy Wobblers

In a pivoted titanium frame, cylindrical wobblers, provided with a longitudinal 7 mm diameter bore and consisting of TiAlV64 alloy, are arranged in 4 columns of 8 pieces each, and surface pre-treated by means of pressure jets with silicon carbide (100 microns) in FRIGEN 113 at a jet pressure of 8 atm.

Following PER washing and toluene-rinsing, the wobblers are placed into the aluminizing bath and are coated with an approximately 15 micron galvano-aluminum layer, accompanied by reciprocal movement of the frame and rotation of the columns.

Subsequently, they are intensively anodized (under conditions as described above) and dyed in a SANDOZ color bath of Al-Blue LLW (2 g/l) at room temperature for 2.5 min. The galvano-aluminum eloxation-layer surface is solidified in boiling water for 30 min. and has an homogeneous, light-blue and glare-free appearance.

This is particularly important when a uniform, decorative surface appearance is required for an article fabricated of aluminum alloy, brass and titanium components.

EXAMPLE 11

Punch-Pressed Parts Of Brass Sheet Coated On Both Sides With Electroplated Aluminum A piece of brass strip 70 mm wide and 0.5 thick is surface-treated by etching for 30 seconds in a phosphoric-acid containing etching solution, which is commercially available, for instance, from Schering AG, as TRINORM "Fe". Then it is thoroughly washed with water, cathodically degreased in an alkaline or cyano-alkaline bath (comercially available as UNAR 58 or Degreasing Bath NORMAL) for about 20 seconds and pickled in 10-percent sulfuric acid. After intensive rinsing with deionized water for about 1 minute, the adhering water is displaced by immersing the brass sheet strip in a dewatering bath (dewatering fluid commercially available, for instance, as HAKUDREN), and the dry strip is immediately immersed in toluene, where any residual dewatering fluid is removed under the action of ultrasonic vibration.

Still wet with toluene, the brass strip then is placed in the aluminizing cell and is coated at a bath temperature of 70 to 90° C and with the electrolyte comprising one part $[(CH_3)_3(C_6H_5)N]$ Cl, 2.2 parts of Al $(C_2H_5)_3$, and 4 parts of $C_6H_5CH_3$, circulated by pumping, in an inert atmosphere ($N_2$ or Ar) free of air and moisture, between Raffinal plate electrodes (electrode spacing approximately 10 mm). Both sides of the strip are electroplated with an aluminum coating about 30 microns thick. Depending on the motion of the electrolyte, current densities of up to 0.04 A/cm$^2$ with only a few volts of bath voltage, and deposition rates of up to about 40 microns per hour can be obtained. The electroplated aluminum layer has a very fine-grained, silver-bright appearance and adheres very well to the brass strip.

From the brass strip, retaining ring parts with a 10-mm deep profile of 52 mm outside diameter and 22 mm inside diameter are made on a punch press in one operation. The electroplated aluminum withstands the partially complicated forming process without the formation of cracks and has assumed a shiny appearance at the heavily deformed portions. At the stamping edges, the shaping tool has pulled down the electroplated aluminum over the height of the edge, so that the brass is no longer visible. The high ductility and the good thermal conductivity of the electroplated aluminum make possible a short cycling time of the stamping operation.

By means of hydraulically jetting with glass spheres of about 0.1 to 0.6 mm diameter, the electroplated aluminum layer can be hammered smooth and burnished prior to stamping. After deformation, the parts exhibit a silver-bright luster on all sides. If the stamped edges are well coated with electroplated aluminum (if the necessary, the stamped edges can also be protected with a resistant lacquer) the parts can be eloxized in a GS (d-c sulfuric acid) bath to a thickness of about 7 microns and, if desired, can be printed, or stained with a clear stain in boiling water for 20 minutes.

EXAMPLE 12

Punch-Pressed Parts Of Sheet Steel Coated On Both Sides With Electroplated Aluminum A steel strip (60 mm wide by 0.15 mm thickness and comprising 0.33% Mn, 0.07% C, 0.04% Al, 0.023% S, 0.017% P, remainder Fe) is freed on both sides from its thin oxide or scale layer by hydraulic jetting at 6 atm. gauge with corundum powder (80 micron particle diameter) in oil. The thin strip rests alternatingly on a flat steel support during this process.

The metallic, bare steel strip protected against renewed oxidation and hydration by an oil film, is cleaned by washing in liquid perchlorethylene and degreasing in perchlorethylene vapor and is immediately placed in toluene, where residual perchlorethylene is removed by ultrasonic action. The bare strip, still wet with toluene, is then introduced into the aluminizing cell and coated in a vigorously agitated electrolyte (one part NaF, 2 parts $Al(C_2H_5)_3$, 3.5 parts toluene) at a bath temperature of 80°–100° C, applying a pulsed current (50 Hz, current density 0.015 A/cm$^2$, anodic-cathodic loading ration of 1:5) with about 20 microns of electroplated aluminum. A silver-bright, finely crystalline, well-adhering electroplated aluminum layer is obtained, which allows a stamping process to be performed extremely easily and rapidly.

Instead of the above-mentioned anhydrous surface pretreatment, the steel strip can also be cleaned in a phosphoric-acid containing bath (commercially available as TRINORM "Fe") by etching, and then pretreated by cathodic degreasing with copper flash (less than 1 micron, preferably 0.3 to 0.5 micron of copper) in an alkaline bath. After washing with deionized water, the strip is dried with a dewatering agent (Dewatering Fluid, commercially available, for instance, as HAKUDREN), given an after-rinse in a toluene rinsing bath, and the copper-preplated steel strip is aluminized by electroplating as described above.

From both steel strips coated with electroplated aluminum, deep-profile set rings, flanged cups, hollow-profiled parts and the like can be produced in a particularly advantageous manner on a stamping press.

EXAMPLE 13

Corrosion Behavior Of Punched And Cut Edges In Steel Strip Coated With Electroplated Aluminum From steel strip 0.15 mm thick, made according to Example 12 and coated on both sides with electroplated aluminum, 50 × 50 mm test samples are punched and provided on two opposite sides with eight cuts each, 15 mm long. The test samples are then subjected to the tropical-climate test at 40° C and 100% air humidity for 400 hours.

As a result of the electroplating of the pre-treated strip, the punched and cut edges are coated so well with electroplated aluminum, i.e., covered over, that practically no rust forms. The previously shiny aluminum surface appears merely spotty. This, too, can be avoided by a previously applied eloxal layer of 1 to 3 micron thickness.

EXAMPLE 14

Depth Measurements For Testing The Elongation Behavior Of Steel Strip Coated With Electroplated Aluminum From the steel strip prepared according to Example 12, coated on both sides with electroplated aluminum, 60 mm wide and 0.15 mm thick, pieces 75 mm long are cut and used for the depth measurement according to Erichsen (DIN 50101). The measurements are carried out with a sphere of 20 mm diameter.

In all test pieces, depressions between 8.5 and 9.0 mm are measured and smooth cracks without separation from the steel base were observed. All values therefore met the specified value for deep-drawing quality of the steel strip.

EXAMPLE 15

Deep-Drawing Of Shells Of Cold-Rolled Strip Coated With Electroplated Aluminum Or Zinc Cylindrical shells of several millimeters to several centimeters inside diameter are customarily pressed or deep-drawn from brass, copper or aluminum materials.

In order to attain greater strength or thinner walls, ferrous materials (steels) have also been used, but the stronger material poses greater fabrication difficulties and causes more tool wear. With auxiliary forming agents, the deep-drawing is made considerably easier and technical advantages can be obtained, such as improvement of the drawing properties of the base material, excellent dry-lubrication film, longer tool life, elimination of intermediate annealing, working with thinner walls, and others.

Metals electroplated in accordance with this invention are advantageous auxiliary forming agents, which are parituclarly well suited, for the manufacture of shells by deep-drawing. For this purpose, a cold-rolled steel strip of 1 to 2 mm thickness is coated, preferably in a continuous process, with 10 to 30 microns of electroplated aluminum or zinc. The layer thickness of the electroplated metal depends on the degree of forming to which the substrate metal is to be subjected. The electroplated aluminum layer can be applied as described in Examples 11 and 12. With the same surface pretreatment, organo-zinc onium salt-complex electrolytes are used for the application of the electroplated zinc layer, as for instance, can readily be prepared in accordance with German Pat. No. 1,200,817, i.e.

one part $[(CH_3)_3(C_6H_5CH_2)\ N]F$;2.2 parts of $Zn(C_2H_5)_2$; 2.5 parts of $C_6H_5CH_3$, or one part $[(C_2H_5)_4N]Cl$; 2.2 parts of $Zn(C_2H_5)_2$; 3.0 parts of $C_6H_5CH_3$, or one part $[(CH_3)_4N]Cl$; 2.2 parts of $Zn(CH_3)_2$; 4.0 parts of $C_6H_6$ At electrolyte temperatures of between 60° and 100° C, these electrolytes have conductivity values in the range of $10^{-2}$ ohm$^{-1}$ cm$^{-1}$ and permit depositions employing cathode current densities of 0.005–0.02 A/cm$^2$ and bath voltages of 2–10 V (depending on the electrode spacing), a pure, silver-bright electroplated zinc in compact form on the substrate metal surface, with good adhesion and free of hydrogen.

From the electroplated aluminum- or zinc-coated cold-rolled strip, circular discs of 20 to 25 mm diameter are blanked out for deep-drawing shells of 16 mm diameter and 56 mm length and are fabricated in 6 drawing operations in a multiple-plunger press into the above-mentioned shells, which show a smooth to shiny silver-bright appearance.

EXAMPLE 16

Stamped Parts Of Brass Sheet Coated On Both Sides With Electroplated Indium

After a surface pretreatment suited for the material, a brass strip of 100 mm wide and 0.3 mm thick is coated in organometallic electrolytic media, such as are described in the German Pat. Nos. 1,236,208, 1,170,658, 1,483,344 and 1,200,817 with a thin (10 to 20 microns) electroplated indium layer of 10 and subsequently fabricated in a stamping press to make covers, parts with annular grooves, shells or the like.

Having thus described the invention, we claim:

1. In a process of electroplating a metal article, the improvement of pre-treating the surface of said article by impinging an anhydrous, aprotic liquid against the surface of said article by falling drops for the purpose of removing scale and exposing bright metal, and subsequently electroplating said article in an aprotic organometal liquid electroplating electrolyte essentially devoid of water and molecular oxygen.

* * * * *